US011810741B2

(12) United States Patent
Canales Benavides et al.

(10) Patent No.: US 11,810,741 B2
(45) Date of Patent: Nov. 7, 2023

(54) INCREASED PUSH TRAVEL ALTERNATIVE FOR ENERGY REGULATOR

(71) Applicants: Gustavo Alonso Canales Benavides, Nuevo Laredo (MX); Ruben Simon Romero, Nuevo Laredo (MX); Javier Tomas Aguilar Fernández, Nuevo Laredo (MX)

(72) Inventors: Gustavo Alonso Canales Benavides, Nuevo Laredo (MX); Ruben Simon Romero, Nuevo Laredo (MX); Javier Tomas Aguilar Fernández, Nuevo Laredo (MX)

(73) Assignee: Robertshaw Controls Company, Itasca, IL (US)

( * ) Notice: Subject to any disclaimer, the term of this patent is extended or adjusted under 35 U.S.C. 154(b) by 0 days.

(21) Appl. No.: 17/509,707

(22) Filed: Oct. 25, 2021

(65) Prior Publication Data

US 2022/0148831 A1 May 12, 2022

Related U.S. Application Data

(60) Provisional application No. 63/111,167, filed on Nov. 9, 2020.

(51) Int. Cl.
*H01H 37/52* (2006.01)
*H01H 9/02* (2006.01)

(52) U.S. Cl.
CPC ..... *H01H 37/52* (2013.01); *H01H 9/02* (2013.01)

(58) Field of Classification Search
CPC ..... H01H 37/52; H01H 9/02; H01H 11/00; H01H 9/26; H01H 13/72; H05F 1/00
USPC ..... 200/573, 302.2; 29/622
See application file for complete search history.

(56) References Cited

U.S. PATENT DOCUMENTS

| | | | |
|---|---|---|---|
| 2,156,440 | A | 5/1939 | Veber |
| 2,623,137 | A | 12/1952 | Vogelsberg |
| 2,838,646 | A | 6/1958 | Welch |
| 2,864,051 | A | 12/1958 | Hoffmann et al. |
| 2,870,290 | A | 1/1959 | Taylor et al. |
| 3,634,802 | A | 1/1972 | Aldous |
| 3,636,490 | A | 1/1972 | Pansing |
| 3,679,988 | A | 7/1972 | Haydon |
| 3,691,404 | A | 9/1972 | Swygert, Jr. |
| 3,725,624 | A | 4/1973 | Emmons |

(Continued)

FOREIGN PATENT DOCUMENTS

| | | | |
|---|---|---|---|
| DE | 2356500 | A | 5/1975 |
| DE | 2364832 | A | 7/1975 |

OTHER PUBLICATIONS

Robertshaw Energy Regulators and Thermostats. Jun. 2009. URL: http://www.thermalproducts.com.au/wp-content/uploads/2013/01/Robertshaw-Cross-Reference-June-2009.pdf.

*Primary Examiner* — Edwin A. Leon
*Assistant Examiner* — Iman Malakooti
(74) *Attorney, Agent, or Firm* — Reinhart Boerner Van Deuren P.C.

(57) ABSTRACT

An infinite switch includes a front cover, a back cover, and a base secured between the front cover and the back cover. A floating shaft extending through the front cover and the base. A cam fixed to the base and slidingly receiving an end of the floating shaft. The floating shaft is moveable in an axial direction extending parallel to a longitudinal axis of the floating shaft and the cam is fixed to prevent movement in the axial direction.

19 Claims, 6 Drawing Sheets

(56) References Cited

U.S. PATENT DOCUMENTS

| | | | | |
|---|---|---|---|---|
| 3,739,226 | A | 6/1973 | Seiter et al. | |
| 3,740,823 | A | 6/1973 | Watkin | |
| 3,761,649 | A | 9/1973 | Jedynak et al. | |
| 3,776,124 | A | 12/1973 | Morley | |
| 3,789,688 | A | 2/1974 | Minks | |
| 3,809,862 | A | 5/1974 | Simmons | |
| 3,843,286 | A | 10/1974 | Horberg, Jr. et al. | |
| 3,846,726 | A | 11/1974 | Hierholzer, Jr. et al. | |
| 3,866,634 | A | 2/1975 | Rutkevich et al. | |
| 3,878,498 | A | 4/1975 | Allen et al. | |
| 3,905,003 | A | 9/1975 | Rosenberg et al. | |
| 3,922,627 | A | 11/1975 | Shepherd | |
| 3,932,830 | A | 1/1976 | Holtkamp | |
| 3,975,601 | A | 8/1976 | Whelan | |
| 4,017,702 | A | 4/1977 | Harmon et al. | |
| 4,053,939 | A | 10/1977 | Nakauchi et al. | |
| 4,133,990 | A | 1/1979 | Wanner et al. | |
| 4,167,688 | A | 9/1979 | Burek et al. | |
| 4,173,029 | A | 10/1979 | Rabindran | |
| 4,206,344 | A | 6/1980 | Fischer et al. | |
| 4,214,151 | A | 7/1980 | Kicherer et al. | |
| 4,291,965 | A | 9/1981 | Johnson et al. | |
| 4,302,662 | A | 11/1981 | Kicherer et al. | |
| 4,337,451 | A | 6/1982 | Fox | |
| 4,406,217 | A | 9/1983 | Oota | |
| RE31,597 | E | 6/1984 | Fischer et al. | |
| 4,471,338 | A * | 9/1984 | Holtkamp | H01H 3/20 337/64 |
| 4,495,387 | A | 1/1985 | Thrush | |
| 4,600,164 | A | 7/1986 | Ty et al. | |
| 4,704,595 | A | 11/1987 | Essig et al. | |
| 4,772,779 | A | 9/1988 | Scheidler et al. | |
| 4,788,415 | A | 11/1988 | Whipple, Jr. | |
| 4,876,564 | A | 10/1989 | Amikura et al. | |
| 4,883,983 | A | 11/1989 | Llewellyn et al. | |
| 4,902,877 | A | 2/1990 | Grasso et al. | |
| 4,949,020 | A | 8/1990 | Warren et al. | |
| 4,973,933 | A | 11/1990 | Kadlubowski | |
| 4,993,144 | A | 2/1991 | Llewellyn et al. | |
| 5,021,762 | A | 6/1991 | Hetrick | |
| 5,191,310 | A | 3/1993 | Obermann et al. | |
| 5,219,070 | A | 6/1993 | Grunert et al. | |
| 5,357,082 | A | 10/1994 | Higgins | |
| 5,449,959 | A | 9/1995 | Yang | |
| 5,636,618 | A | 6/1997 | Kirstein | |
| 5,700,994 | A | 12/1997 | Gheer et al. | |
| 6,008,608 | A | 12/1999 | Holsten et al. | |
| 6,050,369 | A | 4/2000 | Leone et al. | |
| 6,064,045 | A | 5/2000 | Reichert et al. | |
| 6,078,169 | A | 6/2000 | Petersen | |
| 6,080,972 | A | 6/2000 | May | |
| 6,191,391 | B1 | 2/2001 | Deo et al. | |
| 6,314,240 | B1 | 11/2001 | Okawara | |
| 6,953,915 | B2 | 10/2005 | Garris, III | |
| 7,208,704 | B1 | 4/2007 | Couts | |
| 8,274,231 | B2 | 9/2012 | Yang | |
| 2016/0209045 | A1 | 7/2016 | Millius | |

* cited by examiner

INCREASED PUSH TRAVEL ALTERNATIVE FOR ENERGY REGULATOR

CROSS-REFERENCE TO RELATED PATENT APPLICATIONS

This patent application claims the benefit of U.S. Provisional Patent Application No. 63/111,167, filed Nov. 9, 2020, the entire teachings and disclosure of which are incorporated herein by reference thereto.

FIELD OF THE INVENTION

This invention generally relates to energy regulators, and more specifically to electro-mechanical energy regulators or infinite switches for use in cooking appliance control.

BACKGROUND OF THE INVENTION

The use of infinite switch energy regulators are well known in the art of energy and load control. They are describe for example in U.S. patent application publication number 2016/0209045 the entire teachings of which are incorporated as if fully set forth herein. Infinite Switch energy regulators are, for example, employed in electric ranges, to control the energy supplied to a load, such as a burner.

In a typical infinite switch energy regulator, depending on the setting of the switch, a duty cycle is selected to be provided as an output from the energy regulator to the load. An infinite switching type energy regulator works on the principle that if the contacts are opened and closed at different on-to-off time ratios, or different duty cycles, sometimes referred to as % (percent) on-times, the energy transmitted to a physical mass, through an electrical load, can be regulated as those ratios are varied. However, in order to regulate the temperature of the heating element to which the electrical power is supplied, the on/off switching of electrical energy requires that the cooktop heating element (load) and physical mass in contact with the heating element, such as a pot or pan with water or food, have a significant lumped thermal capacitance.

An infinite switching type energy regulator typically has a bimetal element coupled to a cycling contact and an internal heater that causes the bimetal element to deform when energy is applied to the internal heater and the resistive load. As the load and the internal heater are heated, the bimetal element deforms and the switch is opened. The cycling contact closes, due to spring forces, after the bimetal has cooled sufficiently to allow it to deform back to its original ambient temperature shape. An infinite Switch energy regulator is typically employed in a 240 volt ac application and the internal heater and collaboration are configured for use in such an application. Typical wiring diagrams of the infinite switches are shown in the prior art FIG. 1. The wiring diagrams are shown in relation to the cam and cam followers typically actuated by a user. The switching arrangements are well known and therefore will not be further discussed herein, however, the mechanical actuation of the infinite switch will be further discussed.

The infinite switch is typically utilized in a cooking appliance as a control mechanism for application and control of power from two power phase lines of the input line power from the utility for 240 volt operation. The application of power is based on a user selection of a temperature and/or mode of operation via a user interface knob that is coupled to a shaft and cam. The user interface is generally a push to turn design well known in the prior art. Indeed, FIG. 2 illustrates a prior art infinite switch 10 in the OFF position and FIG. 3 illustrates the prior art infinite switch 10 in the ON position on the right. The prior art user interface (not illustrated) is mounted at a first end 12 of a prior art shaft 14.

The prior art shaft 14 and cam 16 have always been either a single piece design or a two piece press fitted assembly. This design provides a cam teeth height 17, limited to a maximum of 1.2 mm (millimeter) which functions to limit the push travel distance 18 the prior art shaft 14 can travel to unlock to 1 mm because of its interaction with a neutral break terminal 20. If this is exceeded the neutral break terminal 20 can yield.

The prior art cam teeth 22 inside a base pocket 24 of the prior art infinite switch 10 are the only torque resistance to withstand the UL 873 standard that requires the prevention of shaft rotation without push actuation with a force of 3 Nm. However, the new torque standard of 4 Nm according to UL EN 60730-2-11 cannot be achieved with this design.

However, the single piece design of the cam 16 and the prior art shaft 14 or the two piece press fitted assembly while safe and functional can fail before their desired full life span. The neutral break terminal 20 can yield when the shaft 14 and cam 16 press against it. Indeed, the push force 26 required move from an OFF state to an ON state is a function of the neural break 20 terminal force 28 acting against the cam 16. It has been found that these designs can crack the cam 16 over time.

BRIEF SUMMARY OF THE INVENTION

In view of the above, embodiments of the present invention provide a new and improved electro-mechanical energy regulator, also known as an infinite switch in the appliance industry, that overcomes one or more of the foregoing issues.

This invention separates the shaft and the cam to be independent. The cam now attaches to the base as a clip-on and the shaft is now floating. Internal space is gained by with the base and cover design. With the addition of a spring and the components described, the travel distance of the shaft is doubled over that of previous designs from 1 mm to 2 mm. The neutral break terminal will not yield since the activation mechanism will be a simple cam ramp instead of the cam up/down motion from the prior design.

This new push to turn mechanism design will eliminate several failures modes of current design because the shaft is not pressed/staked against the cam. Also, the cracking odds of the cam will reduce to zero. The push force will be only dependent of the spring force and the push travel only be in function of washer notch height, with a running torque more homogeneous, and an improved shaft wobble due the increase of bearing area inside the new cam design, in summary a more reliable infinite switch mechanism.

This new design meets the new regulatory Agency Standard UL 60730-2-11, 18.101.1. To preventing rotation of the shaft prior to the push or pull actuation shall withstand, without damage or effect on the energy regulator function, a torque of 4 Nm.

Embodiments of the invention separate the shaft and the cam to be independent. The cam now attaches to the base as a clip-on and the shaft is now floating. A spring inside the shaft of this new push to turn design of an infinites switch contribute to the doubling of the push travel distance from 1 mm to 2 mm. Accordingly, the neutral break terminal will not yield since the activation mechanism is a simple cam ramp instead of the cam up/down motion from the prior designs just discussed.

This new push to turn mechanism design eliminates several failures modes of the prior art designs because the shaft it is not pressed/staked against the cam and the cracking odds of the cam will reduce to zero. The push force is dependent only on the spring force. Indeed, depending on the push force desired, the new design permits the use of interchangeable springs of various compression strengths. The push travel in the new design is advantageously only a function of washer notch height, with a running torque that is more homogeneous than the previous designs. Indeed the new design decreases shaft wobble due the increase of bearing area inside the new cam design. Therefore, the design provides a more reliable infinite switch mechanism.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 4:
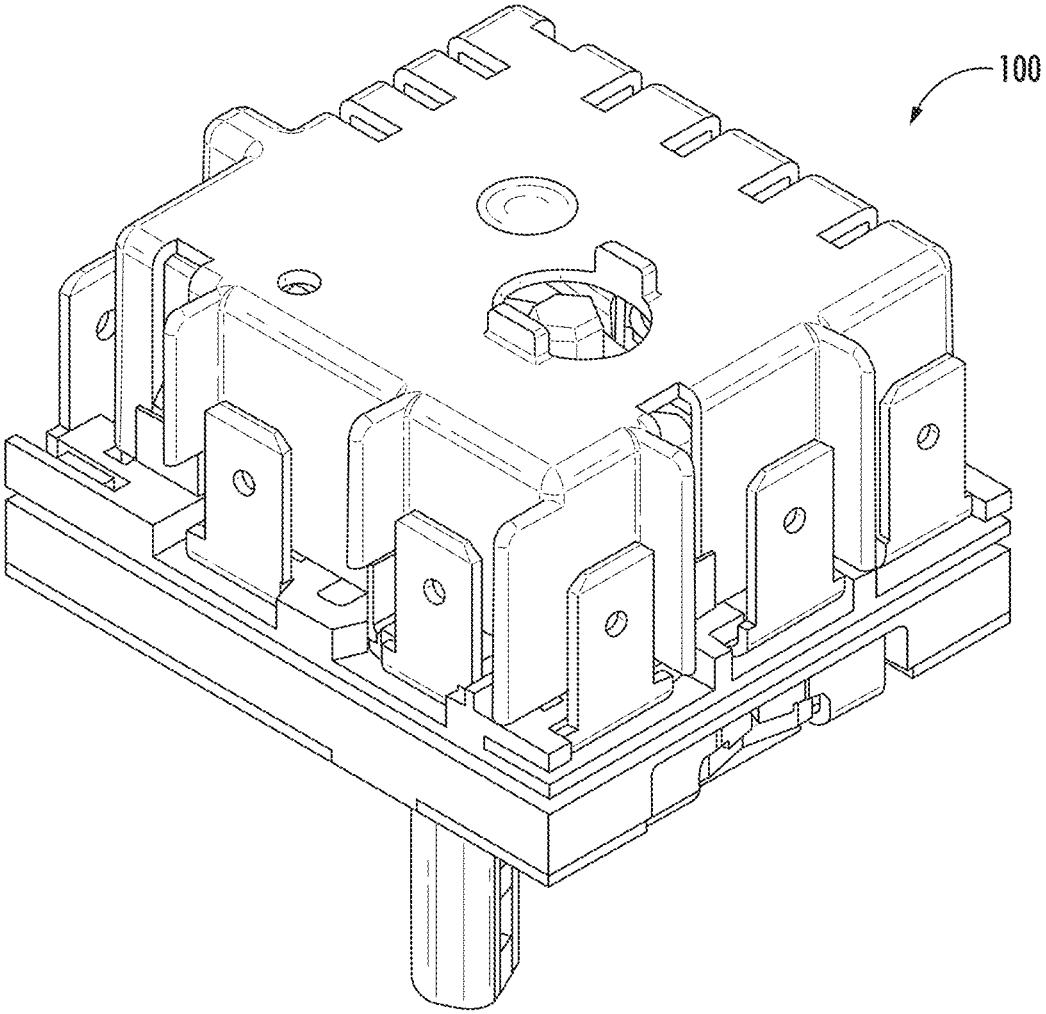
FIG. 4 illustrates an isometric view of an embodiment of an infinite switch according to the teachings of the instant invention.

Turning now to the drawings, there is illustrated in FIG. 4 an exemplary embodiment of an infinite switch 100 according to the teachings of the invention. While such an exemplary embodiment will be utilized in describing various features and advantages of embodiments of the invention, such a description should be taken by way of example and not by limitation. Indeed, advantages of embodiments of the invention can be used to improve infinite switches where it is desirable to improve the reliability and life of the infinite switch 100.

Figure 5:
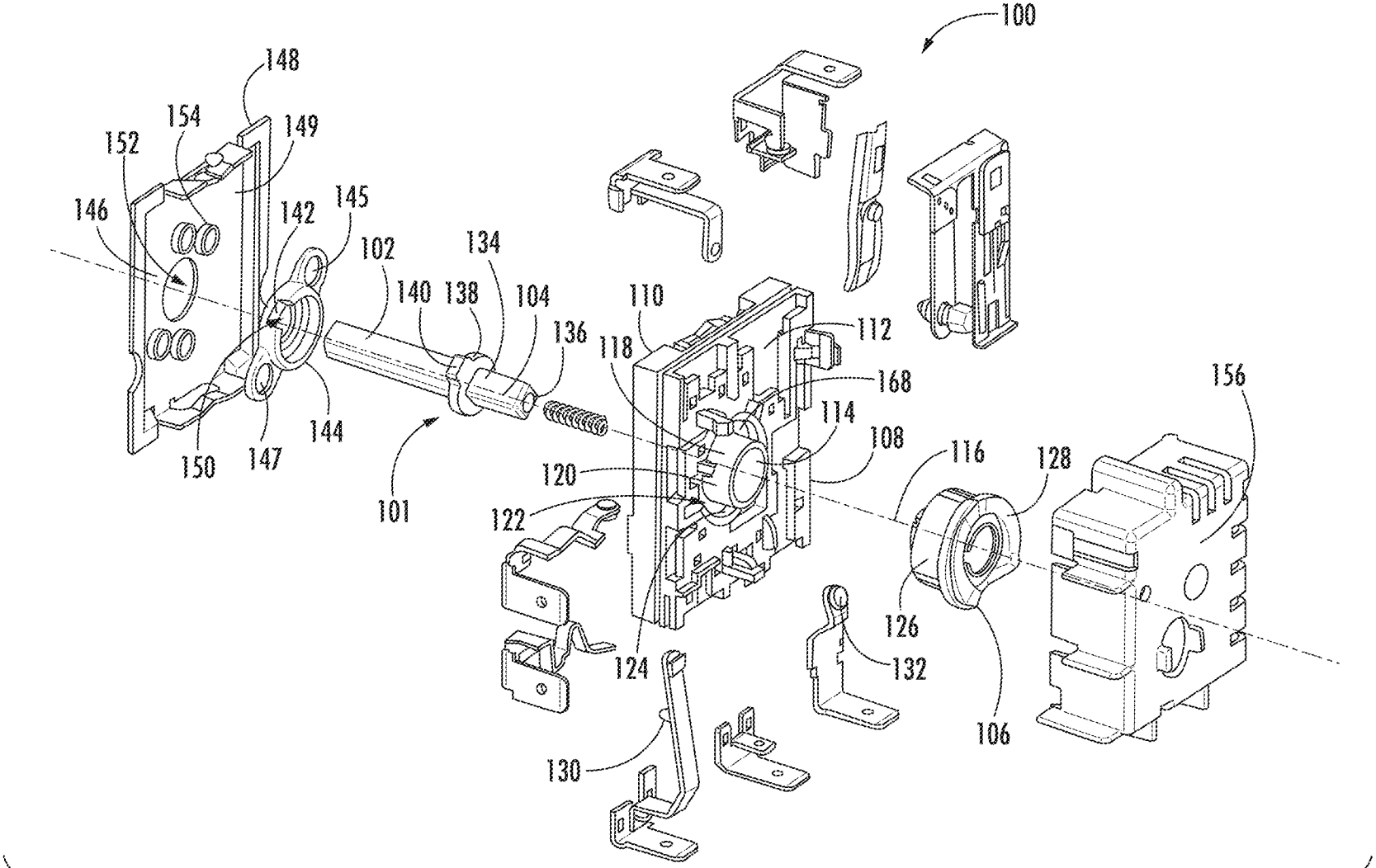
FIG. 5 illustrates an exploded view of the infinite switch of FIG. 4.

FIG. 5 illustrates an exploded view of the infinite switch 100 having a push to turn assembly 101 that includes a floating shaft 102 moveable in a direction parallel to a shaft longitudinal axis 104 within a cam 106 to control the power to a load (not illustrated), typically a burner of a heating appliance.

The push to turn assembly 101 of the infinite switch 100 includes a base 108. The base 108 may be a wall fixed within the infinite switch. The base 108 may have a front face 110 and a back face 112. A base aperture 114 is defined by the front face 110 and the back face 112. The base aperture 114 may be centered about a central axis 116 of the infinite switch 100. The shaft longitudinal axis 104 extends parallel to and along the central axis 116 of the infinite switch 100.

The base 108 defines a pocket 122 centered around the central axis 122. The pocket 122 has a radially outward cylindrical wall 124 and a radially inward cylindrical wall 120. "Radially outward" and "radially inward" are to be understood in relation to the central axis 116. The radially inward cylindrical wall 120 is a cylindrical wall of a hollow mounting boss 118 that surrounds the base aperture 114. The hollow mounting boss 118 extends from a bottom 168 of the pocket 122 away from the front face 110 of the base 108.

Figure 1:
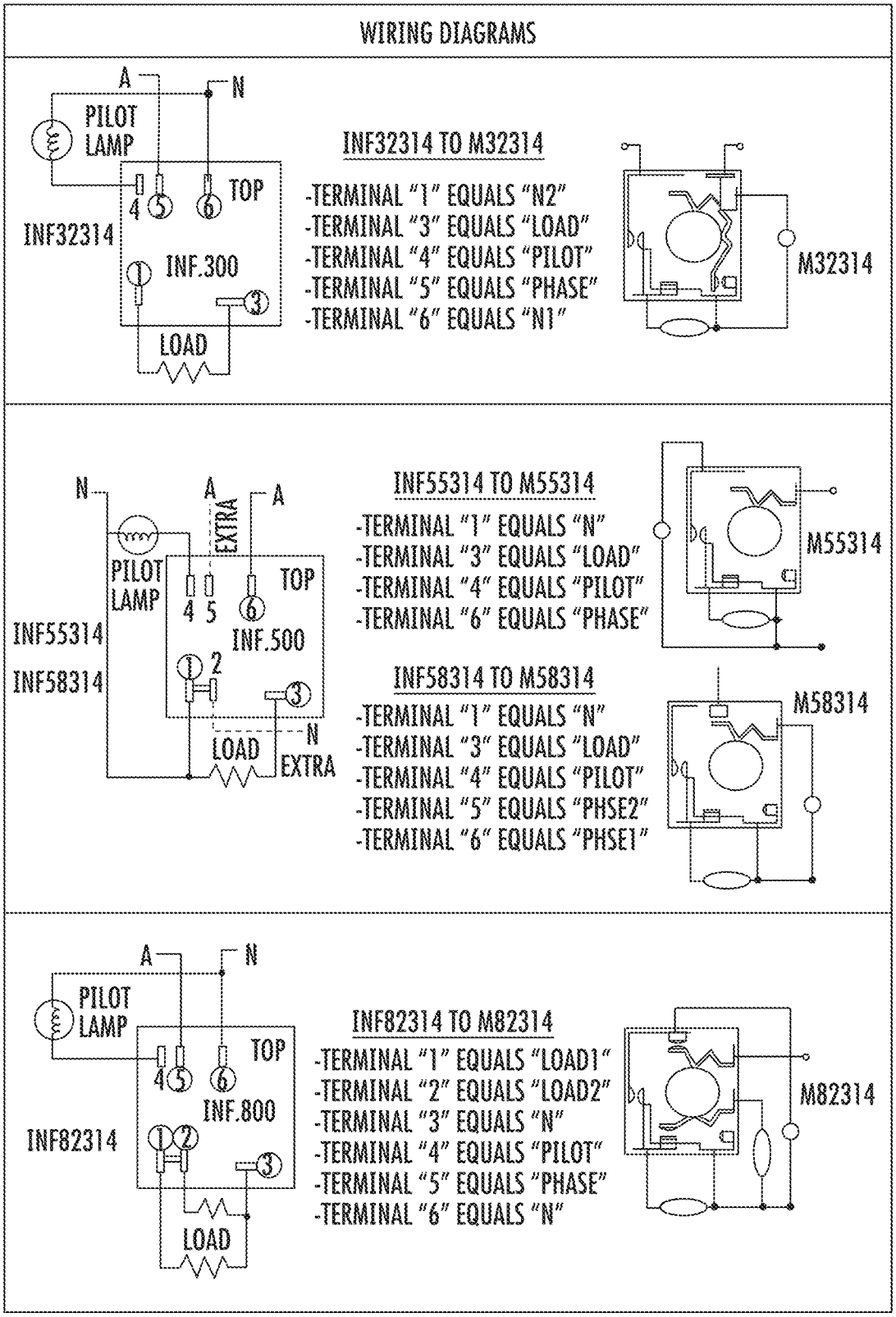
FIG. 1 PRIOR ART
FIG. 1 illustrates typical wiring diagrams of prior art infinite switches.
Figure 2:
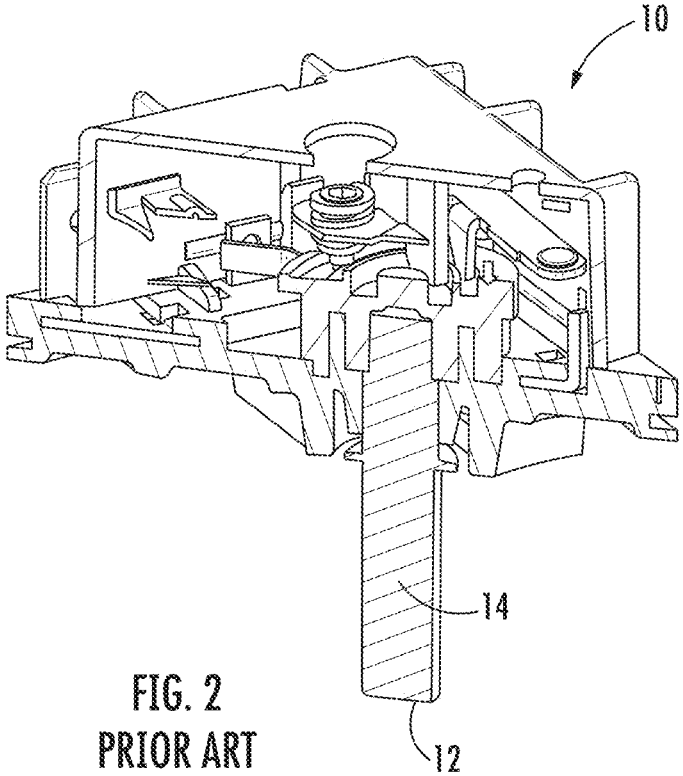
FIG. 2 PRIOR ART
FIG. 2 illustrates a prior art infinite switch in an OFF position.
Figure 3:
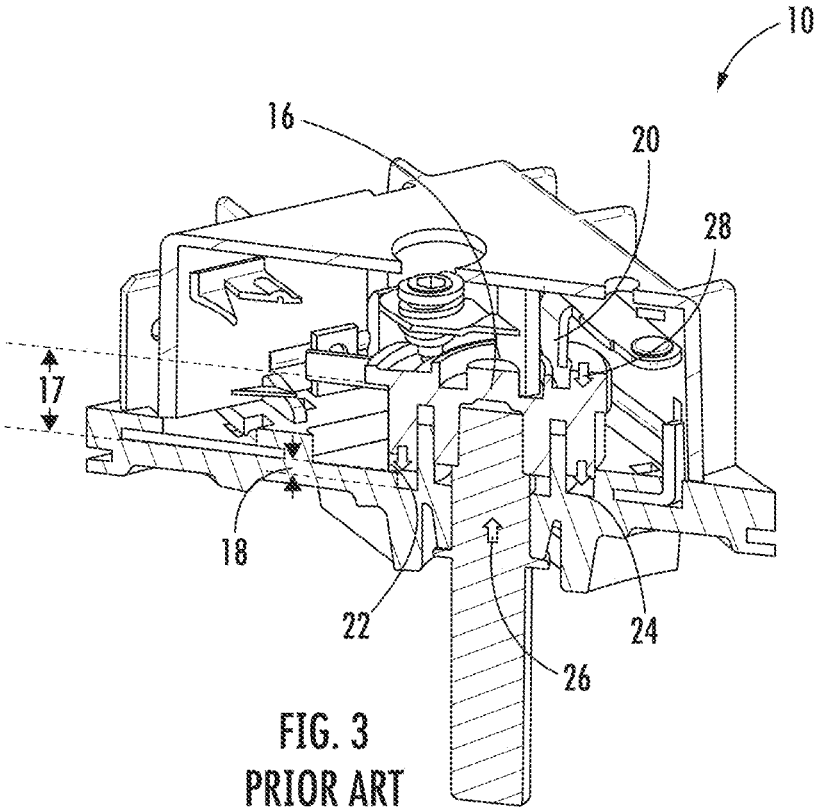
FIG. 3 PRIOR ART
FIG. 3 illustrates the prior art infinite switch of FIG. 2 in an ON position.

The cam 106 has a cylindrical mounting wall 126 that mounts over, so as to surround, the hollow mounting boss 118. The cam 106 includes a ramped surface 128 that acts as a bearing surface for at least one cam follower 130 while the cam 106 rotates so as to close at least one contact 132 within the infinite switch 100. As discussed above, various electrical arrangements within infinite switches that may be used in the infinite switch 100 are well known and will not be described further. See also FIG. 1. Accordingly, it can be readily appreciated that the cam 106 and its ramped surface 128 can actuate more than one cam follower 130.

The floating shaft 102 includes a key end 134 that is received in the cam 106. The key end 134 may be square so as to permit rotational actuation of the cam 106. However, it can be readily appreciated other geometries are possible, for example, the key end could be triangular. The key end 134 defines a channel 136 inside the key end 134 for receiving a spring 132. A ring 138 is fixedly attached to the floating shaft 102. The ring 138 includes a detent 140 that is received into a notch 142 of a washer 144 to prevent rotational movement of the floating shaft 102. Pushing the floating shaft 102 in a direction parallel to the central axis 116 towards a back cover 156 moves the detent 140 outside the notch 142 such that the floating shaft 102 is free to rotate.

The washer 144 includes mounting apertures 145, 147 that permit the mounting of the washer 144 to the front face 110 of the base 108 by fastening means such as screws (not illustrated). The washer 144 is mounted therefore between a front cover 146 of the infinite switch 100 and the front face 110 of the base 108. The front cover 146 has a front side 148 and a back side 149 with a front cover aperture 152. The floating shaft 102 passes through and is supported by the front cover aperture 152. Also, the floating shaft 102 passes through and is supported by a through cavity 150 defined by the washer 144. The front covert 146 includes fixing apertures 154,155 for receiving fasteners therethrough to fasten the front cover 146 to the base 106. The back cover 156 covers the base 106 and is secured thereto by fastening means such as screws. Other fastening means are possible and well known in the art.

Figure 6:
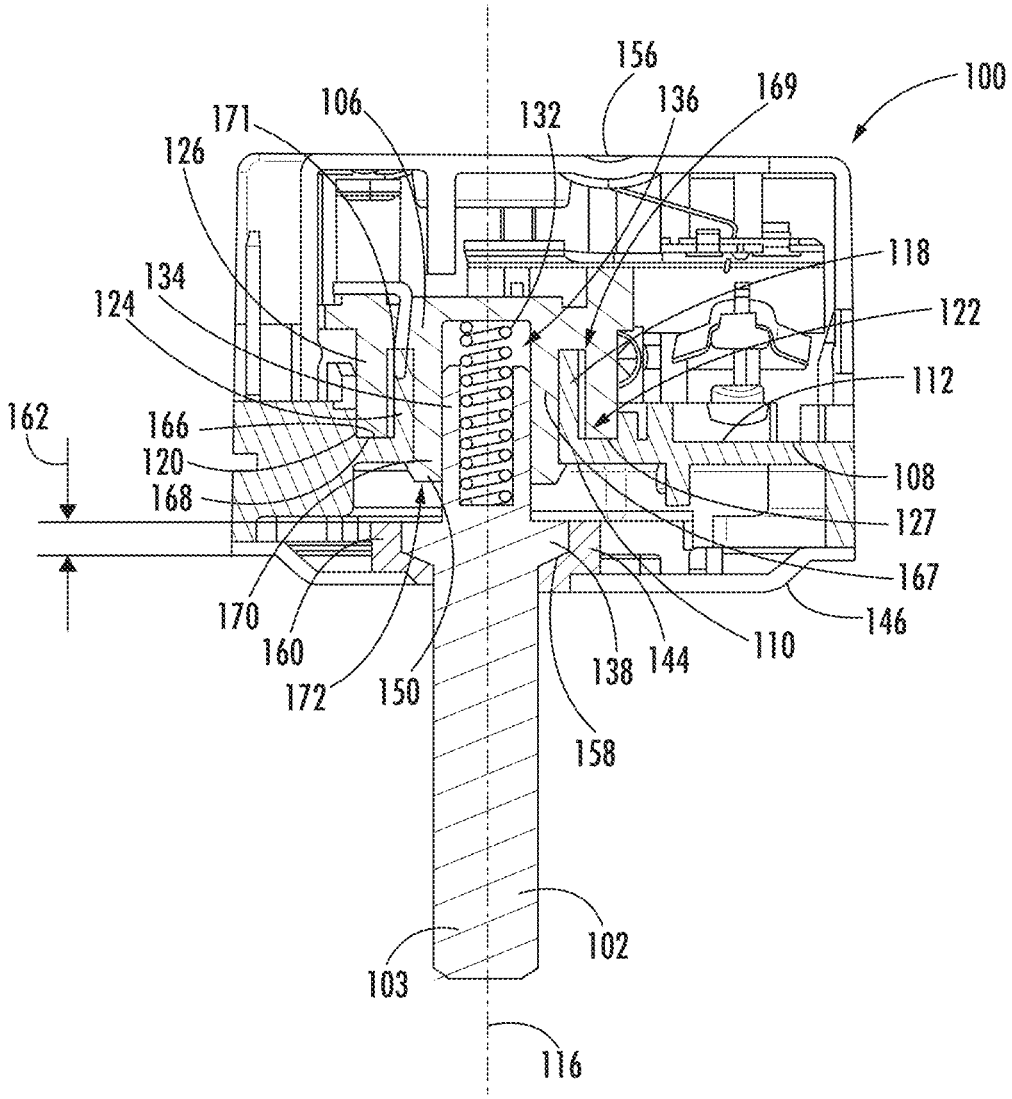
FIG. 6 is an isometric cross section of the infinite switch of FIG. 4.

Turning to FIG. 6, a cross section of the infinite switch 100 is shown. From this view it can be understood that a portion 103 of the floating shaft 102 extends in a direction of extension away from the front cover 146 and the back cover 156 to facilitate actuation by a user. The infinite switch 100 is in the OFF position with the ring 138 and detent 140 (FIG. 5) seated on a bottom 158 of the through cavity 150 of the washer 144. While seated on the bottom 158 of the inner walls surrounding the through cavity 150 (FIG. 5), the ring 138 is fully inside the through cavity 150 (FIG. 5) of the washer 144 and the detent 140 (FIG. 5) is seated fully inside the notch 142 (FIG. 5) such that the floating shaft 102 cannot rotate but is free to move axially, that is in a direction of extension parallel to the central axis 116 towards the back cover 156. The cam 106 is fixed to the base 108 such that the cam 106 may rotate, once the ring 138 is pushed outside the through cavity 150 of the washer 144. However, the cam 106 is axially fixed such that it cannot move in directions extending parallel to the central axis 116.

The spring 132 is located inside the channel 136 of the key end 134 of the floating shaft 102. The spring 132 acts to bias the ring 138 of the floating shaft 102 into the through cavity 150 (FIG. 5) such that the ring 138 abuts the bottom 158 of the washer 144. The through cavity 150 (FIG. 5) is defined by a cylindrical wall 160 of the washer 144 extending from the bottom 158 of the washer 144. The depth 162 of the through cavity 150 is the same as the height of the cylindrical wall 160. Thus, the height 162 of the cylindrical wall 160 defines the push distance the floating shaft 102 must travel before the floating shaft 102 is free to rotate to an ON position.

A mating end 166 of the cylindrical mounting wall 126 of the cam 106 abuts a bottom 168 of the pocket 122 of the base 108 to prevent the cam 106 from moving in an axial direction parallel to the central axis 116 towards the front cover 146. The cam 106 also has a second cylindrical wall 167 radially interior to and spaced apart from the cylindrical mounting wall 126 to define a cylindrical groove 169 therebetween. The cylindrical groove 169 permits the cam to mount over the hollow mounting boss 118. A groove bottom 171 of cam 106 is seated on the top of the hollow mounting boss 118 and therefore prevents the came 106 from moving in a direction extending parallel to the central axis 116 towards the front cover 148.

The second cylindrical wall 167 of the cam 106 includes a fastening end 170 that is generally cylindrical with a surrounding end protrusion 172 that clips to the front face 110 of the base 108 to prevent the cam 106 from moving in a direction extending parallel to the central axis 116 away from the front cover 148. Thus, the cylindrical mounting wall 126 of the cam 106 rests in the pocket 122 and is sandwiched, without being press fit, between the radially inner cylindrical wall 120 and the radially outer cylindrical wall 124 of the pocket 122.

Figure 8:
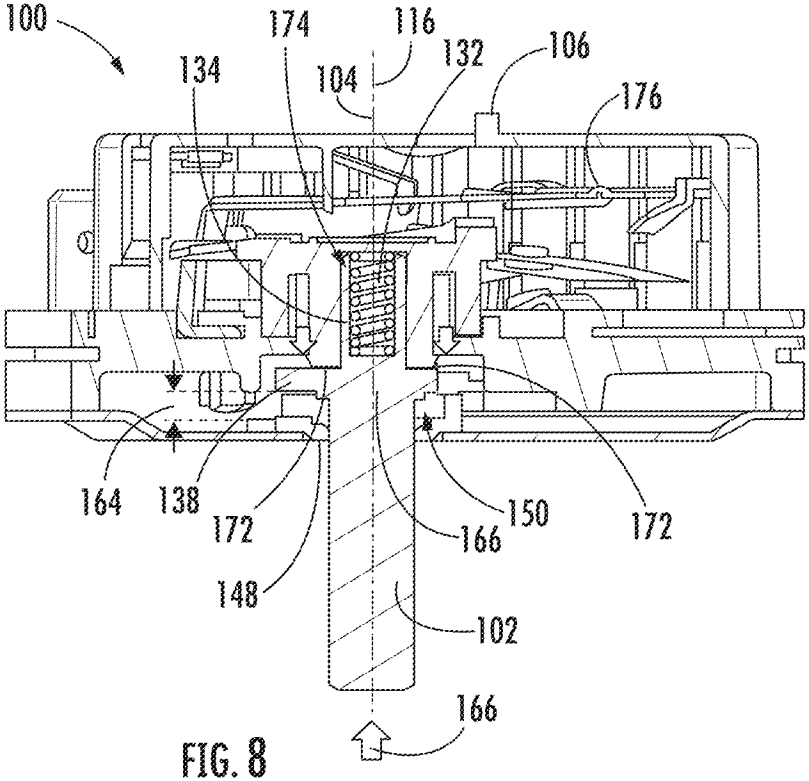
FIG. 8 illustrates the infinite switch of FIG. 4 in an ON position.
Figure 7:
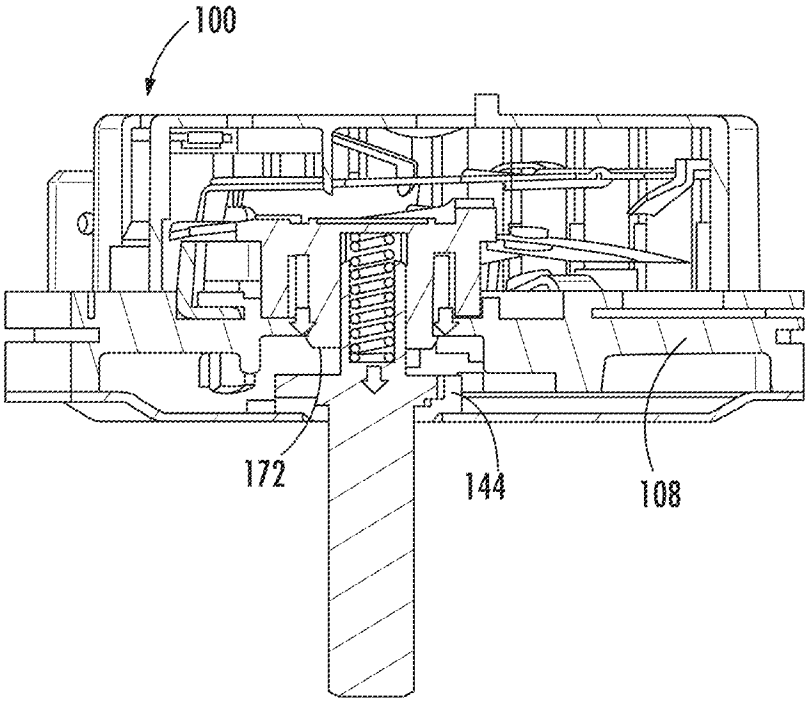
FIG. 7 illustrates the infinite switch of FIG. 4 in an OFF position.

FIG. 7 shows the infinite switch 100 in the in the OFF position while FIG. 8 shows the infinite switch 100 in the ON position. FIGS. 7 and 8 are shown side by for ease of comparison between the two positions/states. The infinite switch 100 of FIG. 7 in the off position was described with respect to FIG. 6 above. Therefore, with respect to FIG. 8 which shows the infinite switch 100 in the ON position, a user applying a push force 166 to the floating shaft 102 moves the ring 138 away from the front cover 148 the push distance 164 until the ring 138 abuts the surrounding end protrusion 172 of the cam 106. Thus the surrounding end protrusion 172 acts as a stop to limit the floating shaft 102 axial movement. The ring 138 having moved the push distance 164 is now completely outside the through cavity 150 of the washer 144. Also, the detent 140 (FIG. 5) which is part of the ring 138 also has moved the push distance 164 such that it outside the notch 142 (FIG. 5) thereby leaving the floating shaft 102 free to rotate. Importantly, the push force 166 acting on the floating shaft 102 compresses the spring 132 to prevent the floating shaft from hitting the cam 106 and cracking it.

It can now be readily appreciated that by floating shaft 102 it is meant that the floating shaft 102 is not press fit in the cam 106 nor unitary such that it forms a single piece with the cam 106. Indeed, the floating shaft 102 is free to move in directions extending parallel to the central axis 116 and the shaft longitudinal axis 104 within the cam 106 while permitting the floating shaft 102 and cam 106 to move rotationally together because of the keyed end 134 of the floating shaft 102 is received into a cooperating cavity 174 of the cam 106 with a matching geometry. For example, if the keyed end 134 is square, then the cooperating cavity 174 is square. Thus, turning the floating shaft 102 turns the cam 106. Because the keyed end 134 is inside the cam 106, the free floating shaft 102 incurs less wear as the cooperating cavity 174 acts as a bearing surface together with the bearing surfaces provided by the front cover 148, and the washer 144. This bearing surface over the entirety of the floating shaft 102 is an improvement over the prior art and acts to prevent shaft wobble.

In light of the foregoing, it can now be readily appreciated that embodiments of the invention separate the floating shaft 102 and the cam 106 so to be independent. By independent it is meant that the floating shaft 102 is free to move in directions that extend parallel to the shaft longitudinal axis 102. The cam 106 attaches to the base 108 as a clip-on so as to permit the independence of the floating shaft 102 relative to the cam 106. The spring 132 inside the floating shaft 102 of this new push to turn design of an infinites switch 100 contributes to the doubling of the push distance 164 from 1 mm to 2 mm. Accordingly, a neutral break terminal 176 will not yield since the activation mechanism is a simple ramped surface 128 of the cam 106 instead of the cam up/down motion from the prior designs just discussed.

This new push to turn mechanism design eliminates several failures modes of the prior art designs because the floating shaft 102 it is not pressed/staked against the cam 106 and the cracking odds of the cam 106 will reduce to zero. The push force 164 is dependent only on the spring force. Indeed, depending on the push force 166 desired, the new design permits the use of interchangeable springs 138 of various compression strengths. The push travel 164 in the new design is advantageously only a function of washer 144 notch 142 (FIG. 5) height 162 (FIG. 6), with a running torque that is more homogeneous than the previous designs. Indeed, the new design decreases the floating shaft 102 wobble due the increase of bearing area inside the cam 106 design. Therefore, the design provides a more reliable infinite switch 100 mechanism that also meets the new torque standard of 4 Nm according to UL EN 60730-2-11.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An infinite switch, the infinite switch comprising:
- a front cover,
- a back cover,
- a base secured between the front cover and the back cover;
- a floating shaft extending through the front cover and the base, the floating shaft having a channel in a keyed end;
- a cam fixed to the base and slidingly receiving the keyed end of the floating shaft;
- a spring extending from inside the channel to abut the cam;
- wherein the floating shaft is moveable in an axial direction extending parallel to a longitudinal axis of the floating shaft and the cam is fixed to prevent movement of the cam in the axial direction.

2. The infinite switch of claim 1, wherein the keyed end has a square cross section and a cooperating cavity of the cam provides a square bearing surface that receives the keyed end such that rotation of the floating shaft rotates the cam.

3. The infinite switch of claim 2, the cam having a ramped cam surface, wherein the rotation of the ramped cam surface moves a cam follower of a terminal within the infinite switch.

4. An infinite switch, the infinite switch comprising:
- a front cover,
- a back cover,
- a base secured between the front cover and the back cover;
- a washer having a cylindrical wall surrounding a through cavity of the washer, the washer fixedly located between the front cover and the base;
- a floating shaft extending through the front cover and the base;
- a cam fixed to the base and slidingly receiving an end of the floating shaft;
- wherein the floating shaft is moveable in an axial direction extending parallel to a longitudinal axis of the floating shaft and the cam is fixed to prevent movement of the cam in the axial direction.

5. The infinite switch of claim 4, wherein the cylindrical wall of the washer includes a notch.

6. The infinite switch of claim 5, wherein the floating shaft extends through the washer, the floating shaft includes a ring having a detent, the ring fixed to and surrounding the floating shaft, the detent receivable in the notch.

7. The infinite switch of claim 6, wherein the cam mounts to a mounting boss of the base, wherein a cylindrical wall of the cam is located between the shaft and the mounting boss.

8. The infinite switch of claim 6, wherein movement of the floating shaft in the axial direction towards the cam a push distance that is equal to the height of the cylindrical wall of the washer, unseats the detent from the notch.

9. The infinite switch of claim 8, wherein the floating shaft and the cam are rotatable only after the detent is completely outside the notch.

10. An infinite switch, the infinite switch comprising:
- a floating shaft extending through a front cover, a washer, and a base to a cam within the infinite switch;
- a ring fixed to and surrounding the floating shaft;
- a first stop defined by the washer;
- a second stop defined by the cam fixed to the base;
- wherein movement of the floating shaft in directions extending parallel to a longitudinal axis of the shaft is limited by the ring as it abuts either the first stop or the second stop.

11. The infinite switch of claim 10, the floating shaft extending through a through cavity of the washer, the through cavity surrounded by a cylindrical wall of the washer.

12. The infinite switch of claim 11, wherein the cylindrical wall includes a notch, the ring includes a detent receivable in the notch, and the floating shaft has a channel in a keyed end, a spring extends from inside the channel to abut the cam.

13. An infinite switch, the infinite switch comprising:
- a floating shaft extending through a front cover, a washer, and a base to a cam within the infinite switch;
- a ring fixed to and surrounding the floating shaft;
- a first stop defined by the washer;
- a second stop defined by the cam fixed to the base;
- wherein movement of the floating shaft in directions extending parallel to a longitudinal axis of the shaft is limited by the ring as it abuts either the first stop or the second stop;
- the floating shaft extending through a through cavity of the washer, the through cavity surrounded by a cylindrical wall of the washer;
- wherein the cylindrical wall includes a notch, the ring includes a detent receivable in the notch, and the floating shaft has a channel in a keyed end, a spring extends from inside the channel to abut the cam;
- the infinite switch having a first state, wherein in the first state the spring biases the ring of the floating shaft into the through cavity of the washer.

14. The infinite switch of claim 13, wherein in the first state the detent is rotationally fixed inside the notch.

15. An infinite switch, the infinite switch comprising:
- a floating shaft extending through a front cover, a washer, and a base to a cam within the infinite switch;
- a ring fixed to and surrounding the floating shaft;
- a first stop defined by the washer;
- a second stop defined by the cam fixed to the base;
- wherein movement of the floating shaft in directions extending parallel to a longitudinal axis of the shaft is limited by the ring as it abuts either the first stop or the second stop;
- the floating shaft extending through a through cavity of the washer, the through cavity surrounded by a cylindrical wall of the washer;

wherein the cylindrical wall includes a notch, the ring includes a detent receivable in the notch, and the floating shaft has a channel in a keyed end, a spring extends from inside the channel to abut the cam;

the infinite switch having a second state, wherein in the second state, a pushing force applied to the floating shaft in a first direction parallel to the longitudinal axis of the shaft and towards the cam compresses the spring between the floating shaft and the cam.

16. The infinite switch of claim 13, wherein in the second state the detent is located outside the notch.

17. The infinite switch of claim 16, wherein in the second state the floating shaft is rotatable.

18. The infinite switch of claim 17, wherein the cam is fixed to the base while the floating shaft moves from the first state to the second state.

19. The infinite switch of claim 18, wherein movement from the first state to the second state requires the pushing force to move the detent outside the notch and a rotational force to rotate the detent such that when the pushing force is removed, the floating shaft does not move in a direction away from cam and the detent abuts the cylindrical wall and remains outside the notch.

* * * * *